US005522354A

United States Patent [19]

Sakamoto et al.

[11] Patent Number: 5,522,354

[45] Date of Patent: Jun. 4, 1996

[54] VALVE MECHANISM FOR INTERNAL COMBUSTION ENGINE

[75] Inventors: Noboru Sakamoto; Kazunori Yasukawa; Masahiro Muramatsu, all of Iwata, Japan

[73] Assignee: Yamaha Hatsudoki Kabushiki Kaisha, Iwata, Japan

[21] Appl. No.: 145,490

[22] Filed: Oct. 29, 1993

[51] Int. Cl.[6] ..... F02F 1/00

[52] U.S. Cl. ..... 123/193.5

[58] Field of Search ..... 123/193.5, 193.3, 123/90.27, 90.33, 90.38, 90.48

[56] References Cited

U.S. PATENT DOCUMENTS

| | | | |
|---|---|---|---|
| 4,612,885 | 9/1986 | Yoshikawa . | |
| 4,785,773 | 11/1988 | Schreiber et al. | 123/193.5 |
| 4,823,747 | 4/1989 | Wagner et al. | 123/193.5 |
| 5,080,057 | 1/1992 | Batzill et al. | 123/193.5 |
| 5,150,675 | 9/1992 | Murata | 123/193.5 |
| 5,213,071 | 5/1993 | Iwata et al. | 123/193.5 |

*Primary Examiner*—Marguerite Macy
*Attorney, Agent, or Firm*—Knobbe, Martens, Olson & Bear

[57] ABSTRACT

A number of embodiments of cylinder head constructions wherein the cylinder head is comprised of a main cylinder head member that slidably supports the valves for the engine, and which has an upper peripheral edge that defines a cam chamber. At least one camshaft and the tappets associated thereby are supported by a separate cam and tappet carrier member that is affixed to the main cylinder head member. Various arrangements are shown wherein one or both camshafts and the tappets associated therewith may be carried by the cam and tappet carrier member and lubricating and fastening variations are also disclosed.

20 Claims, 13 Drawing Sheets

VALVE MECHANISM FOR INTERNAL COMBUSTION ENGINE

BACKGROUND OF THE INVENTION

This invention relates to a valve mechanism for an internal combustion engine and, more particularly, to an improved cylinder head and valve actuating system for an overhead camshaft internal combustion engine.

It is well recognized that the performance of internal combustion engines can be improved through the use of overhead valves operated by overhead mounted camshafts. When an overhead camshaft arrangement is employed, the cylinder head assembly tends to become much more complicated than with a conventional pushrod operated engine. This is because the cylinder head must, in addition to supporting the valves and the valve springs, provide support for the camshaft and for the actuators for the valves. Frequently, the valves are directly operated and this means that an arrangement must be provided for slidably supporting the thimble tappets that operate the individual valves from the camshaft.

If all of these functions are performed primarily by the cylinder head, then the cylinder head casting becomes extremely complicated. In addition, since it is necessary to machine the bearings for the camshaft provided by the cylinder head, and the bores for slidably supporting the tappets, then machining operations also add significantly to the cost of the cylinder head. Furthermore, there is the problem of assembly of all of the components into such a unitary cylinder head assembly, and the problems of accessibility of the various fasteners for securing the cylinder head to the cylinder block and the bearing caps to the cylinder head for journalling the camshaft. Of course, the problems mentioned above are complicated when the engine employs twin overhead camshafts.

It has been proposed, therefore, to employ a construction wherein the main cylinder head member itself does not have to perform all of these functions. For example, in U.S. Pat. No. 4,612,885, entitled Camshaft Bearing Arrangement For Overhead Cam Engine, issued Sep. 23, 1986, in the name of Masaaki Yoshikawa, and assigned to the assignee hereof, there is depicted a cylinder head arrangement wherein the main cylinder head assembly only supports the poppet valves for their movement and the return springs for the poppet valves. The camshafts and valve actuating tappets are supported in a separate cam carrier that is affixed to the cylinder head and thus can be machined and cast separately simplifying the aforenoted problems. However, with the arrangement shown in that Patent, the cam carrier forms the outer periphery of the cylinder head and the cam cover must sealingly engage it. In addition, the cam carrier must have a sealing arrangement around its outer periphery with the upper surface of the cylinder head to afford sealing. Hence, substantial additional machining operations are required.

It is, therefore,a principle object of this invention to provide an improved cylinder head assembly for an overhead camshaft internal combustion engine.

It is a further object of this invention to provide an improved cylinder head assembly for an overhead cam internal combustion engine wherein at least some of the valve actuating tappets and at least one of the camshafts are supported by a separate cam carrier member that is affixed to the cylinder head but in such a way that this cam carrier member need perform no sealing functions for the overall cylinder head assembly.

It is a further object of this invention to provide an improved and simplified cylinder head assembly for an internal combustion engine having an overhead camshaft wherein machining and assembly operations are considerably simplified.

In addition to the problems already noted, it is also desirable to ensure that the cam actuating tappets and camshafts are well lubricated. When a separate cam carrier member is provided, this can present additional difficulties in insuring that the camshafts are adequately lubricated as are the valve actuating tappets.

It is, therefore, a still further object of this invention to provide an improved cylinder head assembly including an improved arrangement for lubricating the camshaft journals thereof.

SUMMARY OF THE INVENTION

A first feature of this invention is adapted to be embodied in a cylinder head assembly for an overhead camshaft engine that comprises a main cylinder head member which defines a lower sealing surface for sealing engagement with a cylinder block. At least one portion of the lower surface cooperates with a cylinder bore of the cylinder block to define a combustion chamber. The main cylinder head member further has an upper peripheral surface that surrounds a cam chamber and which is adapted to be sealingly engaged with a cam cover for enclosing the cam chamber. A cam and tappet carrier member is affixed to the main cylinder head member within the cam chamber. The cam and tappet carrier member defines at least one bearing surface for journalling a camshaft and at least one tappet bore for receiving at least one tappet actuated by the camshaft for operating a valve supported by the main cylinder head member.

Another feature of the invention is adapted to be embodied in an arrangement of the type described in the preceding paragraph. In accordance with this feature of the invention, the cam and tappet carrier member is formed with an oil gallery that extends along its length and which is served by an oil passage that extends through a lower surface of the cam and tappet carrier member for cooperation with an oil gallery formed in the cylinder head.

DETAILED DESCRIPTION OF THE PREFERRED EMBODIMENTS OF THE INVENTION

Figure 1:
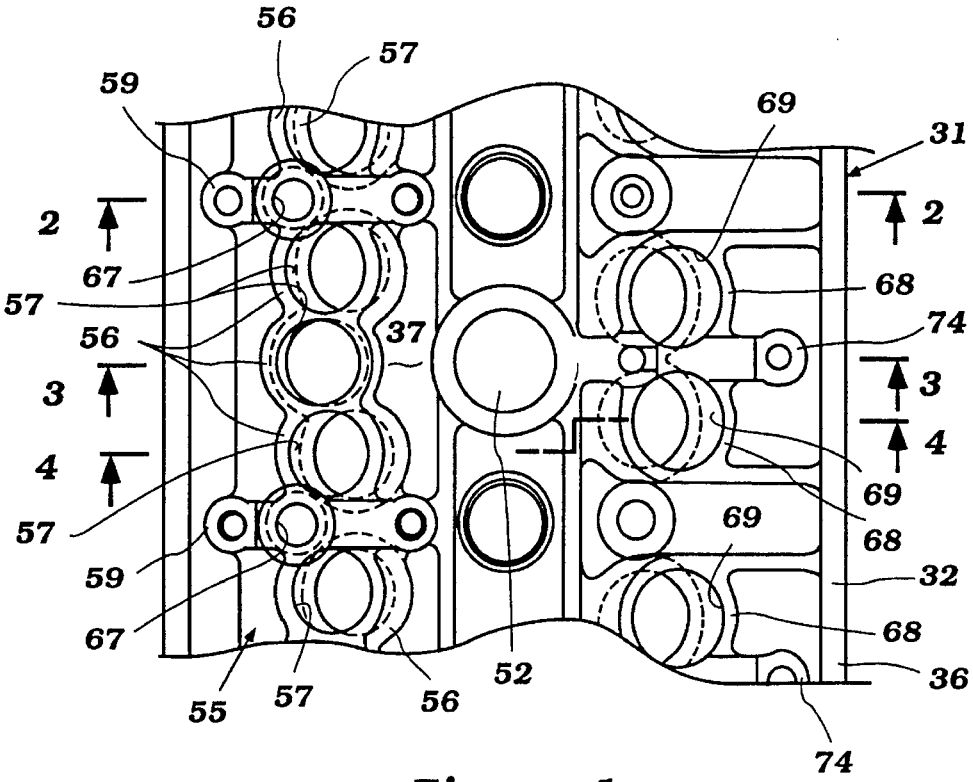
FIG. 1 is a partial top plan view of a cylinder head constructed in accordance with an embodiment of the invention, with the cam cover, camshaft bearing caps and other members removed so as to more clearly show the construction.
Figure 2:
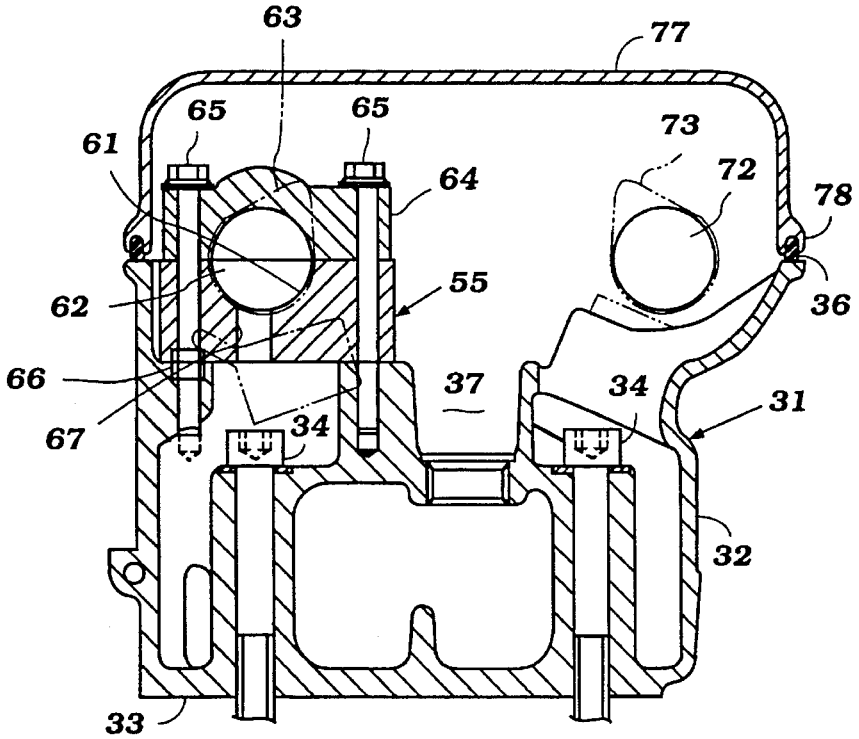
FIG. 2 is a cross sectional view taken along the line 2—2 of FIG. 1, but which also shows the remaining portions of the cylinder head assembly including the cam cover, bearing caps and the means of attachment to the cylinder block.
Figure 3:
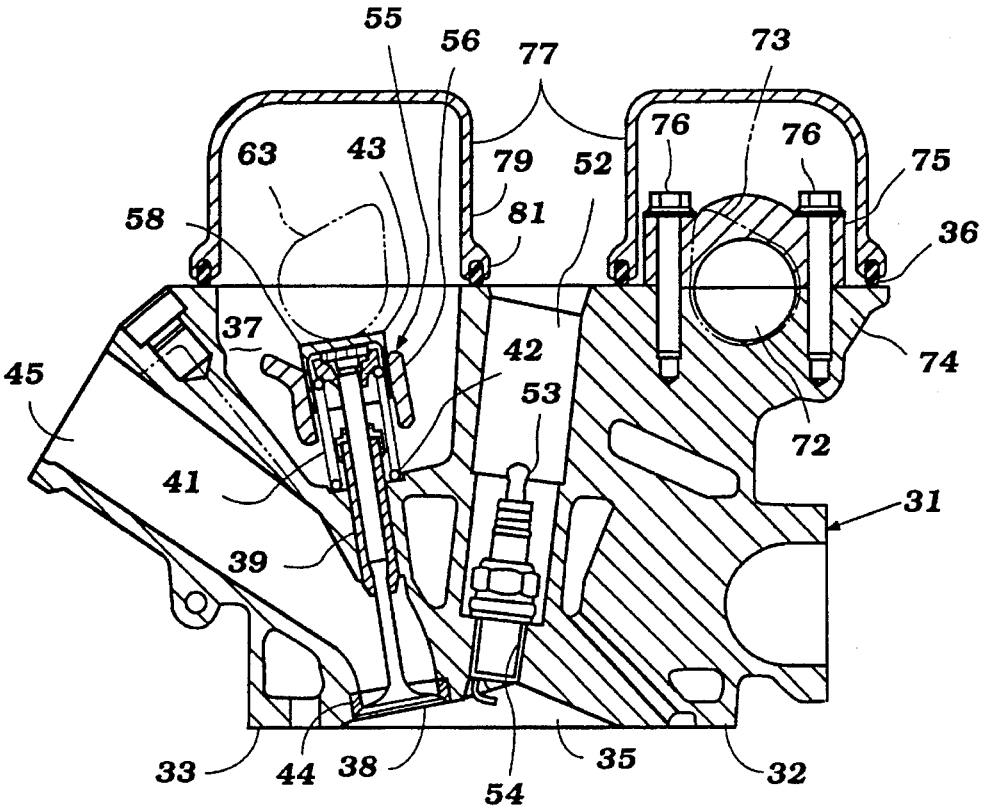
FIG. 3 is a cross sectional view taken along the line 3—3 of FIG. 1 showing all of the components illustrated in FIG. 2, and additional components where encompassed by this section line.
Figure 4:
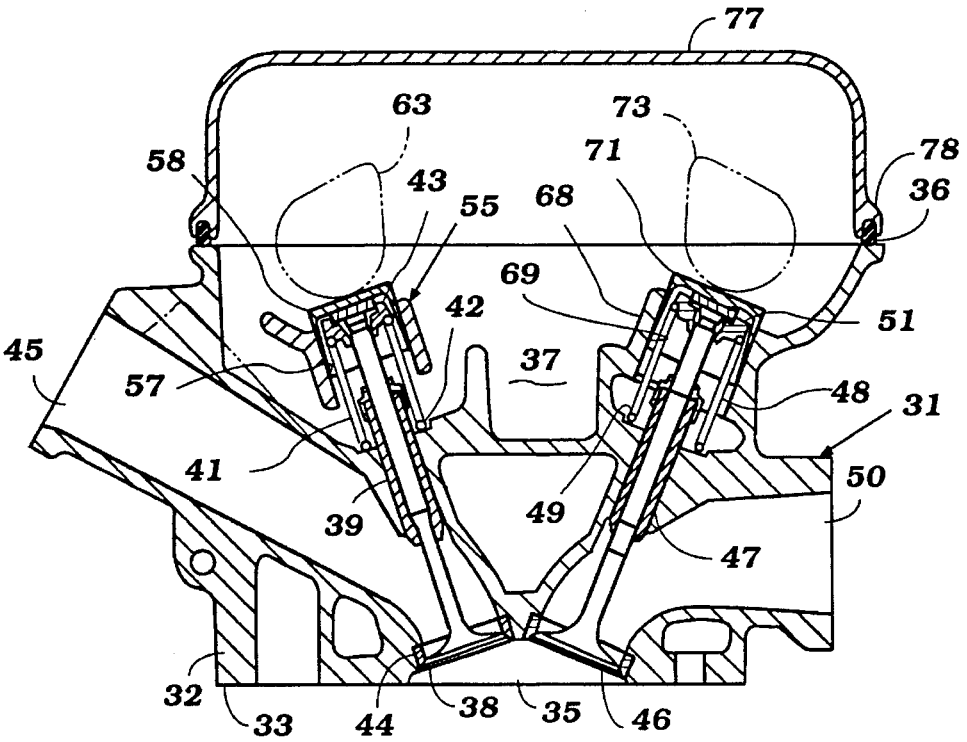
FIG. 4 is a cross sectional view taken along the line 4—4 of FIG. 1 again with certain of the missing components in place.
Figure 5:
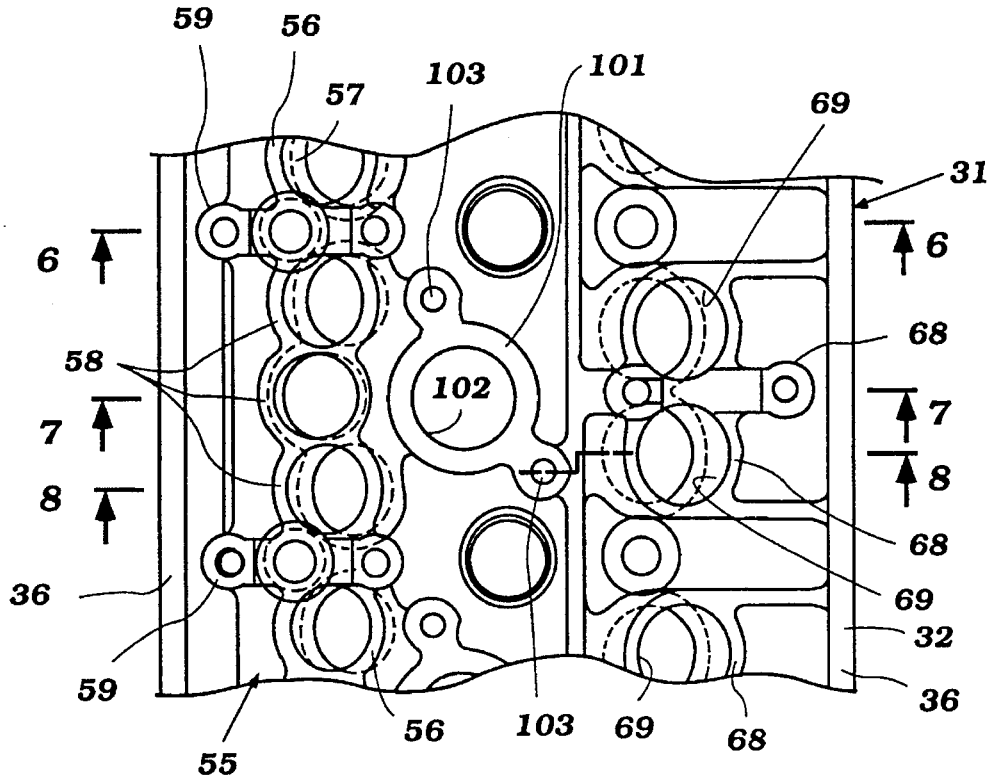
FIG. 5 is a partial top plan view with components removed, in part similar to FIG. 1 and shows a further embodiment of the invention.
Figure 6:
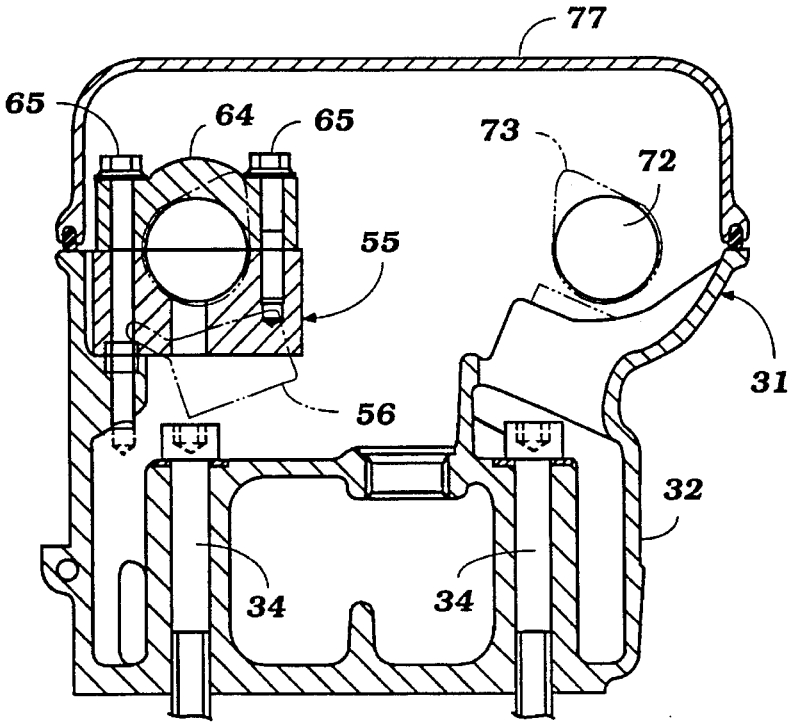
FIG. 6 is a cross sectional view taken along the line 6—6 of FIG. 1 and shows the components removed from FIG. 5.

In each of the embodiments illustrated, only a portion of the cylinder head of an internal combustion engine is depicted and this portion of the cylinder head is not shown in conjunction with the cylinder block, piston and remaining portions of the engine, which may be considered to be conventional. Also, it is not believed necessary to show all cylinders of the engine in the various embodiments because those skilled in the art will readily understand how the invention may be employed in conjunction with multiple cylinder engines. In addition, it is to be understood that the cylinder head depicted in the various embodiments may be the cylinder head for an in-line engine or for one bank of a V-type or opposed engine. Again, it is believed that those skilled in the art can readily understand how the invention can be applied to such engines.

Referring now in detail to the drawings and initially to the embodiment of FIGS. 1 through 4, a cylinder head assembly constructed in accordance with this embodiment is identified generally by the reference numeral 31. The cylinder head assembly 31 includes a number of parts, to be described including a main cylinder head member 32 which is formed conveniently as a casting and may be made from a light weight material such as aluminum, aluminum alloys or the like. The main cylinder head member 32 has a lower sealing surface 33 that is adapted to be affixed to an associated cylinder block by means such as socket head screws 34 or the like. The socket headed screws 34 are disposed around a depressed central area 35 (FIGS. 3 and 4) of the cylinder head surface 33 that is adapted to cooperate with the associated cylinder bore to form the combustion chamber thereof, along with the piston and cylinder bore.

The main cylinder head member 32 is also provided with an upper peripheral sealing surface 36 which surrounds a cam chamber 37 in which a valve actuating mechanism to be described is contained.

In this embodiment, like all of those which will be described, the cylinder head assembly 31 is of the twin overhead cam type embodying a cross flow pattern. To this end, one side, the left side, of the cam chamber 37 comprises the intake side and the other side of the cam chamber 37 comprises the exhaust side. A plurality of intake valves 38 are supported for reciprocation in the main cylinder head member 32 by means of valve guides 39 that are pressed in place. In the illustrated embodiments, there are provided three intake valves for each combustion chamber recess 35. It should be readily apparent to those skilled in the art, however, that the invention can be employed with engines having different numbers of intake valves. The invention, however, has particular utility with multiple valve engines because it easily facilitates the use of actuating mechanisms for such multiple valves.

Each intake valve 38 is biassed toward its closed position by means of a coil compression spring 41 that bears against machined surfaces 42 of the main cylinder head member 32. The other ends of the coil springs 41 act against keeper retainer assemblies 43 that are affixed to the upper ends of the stems of the valves 38. As a result of this construction, the intake valves 38 are all biassed to a closed position, as is well known in this art. The intake valves 38 are opened in a manner which will be described.

The heads of the intake valves 38 cooperate with valve seats 44 that are pressed or otherwise held in place in the cylinder head member 32 and which are formed at the termination of intake ports 45 that extend through the intake side of the main cylinder head member 32. The intake ports 45 may be either individual for each intake valve 38 or may be siamesed in any desired grouping.

Turning now to the exhaust side of the main cylinder head member 32, this includes a plurality of popper type exhaust valves 46 which have their stems slidably supported in valve guides 47 that are pressed into the main cylinder head members 32. In the illustrated embodiment, there are two exhaust valves per cylinder, but, like the intake valves, it is to be understood that the invention may be employed in conjunction with engines having any number of exhaust valves. As with the intake valves, however, the invention has particular utility with multiple valve engines.

Coil compression springs 48 encircle the stems of the exhaust valves 46 and engage at one end machined surfaces 49 of the main cylinder head member 32. The opposites ends of these springs 48 are retained to the stems of the exhaust valves 46 by keeper retainer assemblies 51. Single or siamesed exhaust ports 50 extend from the valve seats to an exhaust system (not shown).

The area between the intake and exhaust sides of the main cylinder head member 32 is provided with a plurality of spark plug wells 52, one for each combustion chamber recess 35 to accommodate a spark plug 53 that is threaded into a tapped opening 54 formed at the base of the well so that the gap of the spark plug 53 will be disposed substantially centrally in the combustion chamber recess 35.

The mechanism for actuating the intake valves 38 will now be described, and this includes a combined cam and tappet carrier member, indicated generally by the reference numeral 55 which may be formed as a casting from a light weight material such as aluminum or aluminum alloy. The carrier member 55 has tappet supporting portions 56 that are provided with machined bores 57 for receiving a thimble type tappets 58 associated with each of the intake valves 36. Since the carrier member 55 is a separate piece, these tappet receiving bores 57 may be easily machined.

The carrier member 55 is also provided with cam lower bearing portions 59 which, in this embodiment, are disposed between adjacent cylinders and which provide bearing surfaces 61 (FIG. 2) for the rotatably journalling the bearing portions of an intake camshaft 62 which has individual cam lobe 63 (FIG. 2) that cooperate with the thimble tappets 58 for opening the intake valves 38 in a well known manner. Individual bearing caps 64 are affixed to the carrier member 55 and also affixed this assembly to the cylinder block by means of bolts 65. Locating pins 66 may be provided at spaced locations to facilitate alignment.

It should be noted that the cam bearing portions 59, and, specifically, the bearing surfaces 61 overly the cylinder head hold down bolts 34. In order to permit retorqueing of these bolts without removing the entire carrier assembly, the carrier member bearing surface 61 are provided with through bores 67 through which a tool may be passed so as to torque down the cylinder head fastener 34 on the intake side.

It should be readily apparent that the intake side of the cylinder head assembly 31 can be easily assembled by placing the intake valves in place with their springs 41 and retainers 43 before the carrier member 55 is installed. Although the upper lower and bearing surfaces 61 of the carrier member are parallel to the lower sealing surface 33 of the cylinder head while the tappet bores 57 are disposed at an angle, this later assembly presents no problem because the tappets 58 can be sized so that they can be in place in the carrier member 55 either before or after the carrier member 55 is placed on the cylinder head member 32. The bores 57 are adequate in size so as to clear the valve spring assemblies during this installation. It should also be noted that the carrier member 55 is disposed inwardly of the cylinder head upper sealing surface 36 within the cam cavity 37 and, in this embodiment, does not extend above this surface.

Turning now to the exhaust side valve of the cylinder head assembly 31 and the actuation for the exhaust valves 46, in this embodiment this is of the conventional type wherein the exhaust camshaft, to be described, and valve actuating thimble tappets are supported within the main cylinder head member 32.

The cylinder head member 32 on the exhaust side is provided with pairs of bosses 68 that are bored as at 69 so as to receive thimble tappets 71. These thimble tappets engage the keeper retainer assemblies 51 for operating the exhaust valves 46. An exhaust camshaft 72 having lobes 73 is journalled in the cylinder head member 32 by bearing portions 74 formed integrally with the exhaust side of the cylinder head assembly between the pairs of bosses 68 for the tappets for each cylinder. Bearing caps 75 are affixed to each of these bosses 74 by threaded fasteners 76 for engaging corresponding bearing surfaces on the exhaust camshaft 72 between the lobes 73 for journalling the exhaust camshaft.

The cam chamber 37 is covered by a cam cover 77 which carries a sealing gasket 78 around its periphery and which sealingly engages the surface 36 of the cylinder head member 32 to close the cam chamber 37. The cam cover 77 is also provided with an opening 79 aligned with the spark plug wells 52 so that spark plugs 53 can be installed and removed without removing the cam cover 77. An "0" ring gasket 81 is provided around the openings 79 for sealing.

Figure 7:
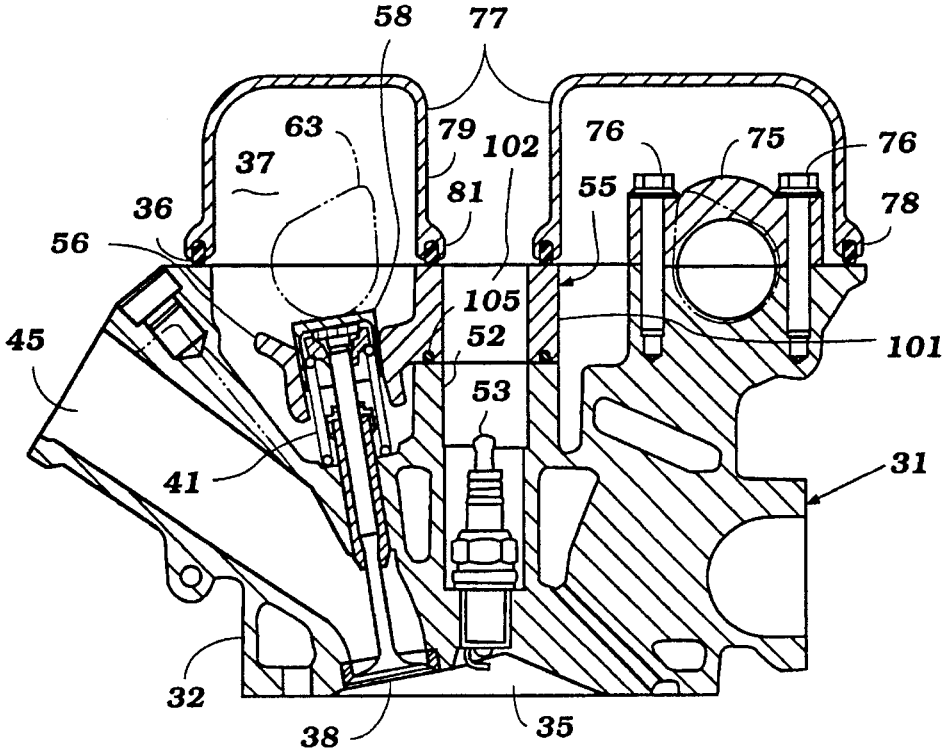
FIG. 7 is a cross sectional view taken along the line 7—7 of FIG. 5 and also shows the removed components.
Figure 8:
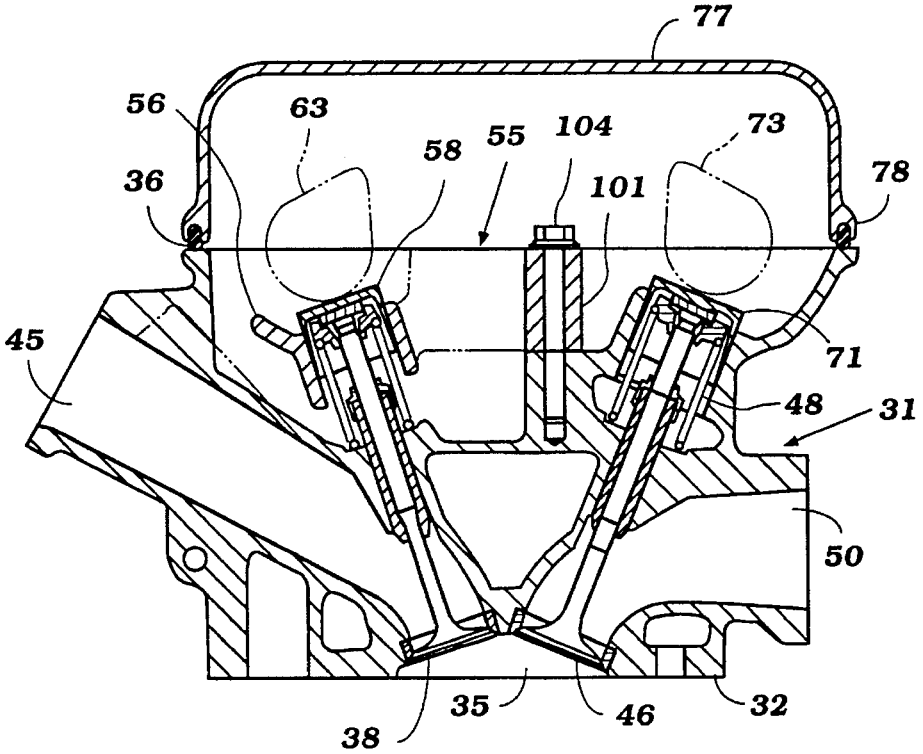
FIG. 8 is a cross sectional view taken along the line 8—8 of FIG. 5 showing the removed components.
Figure 9:
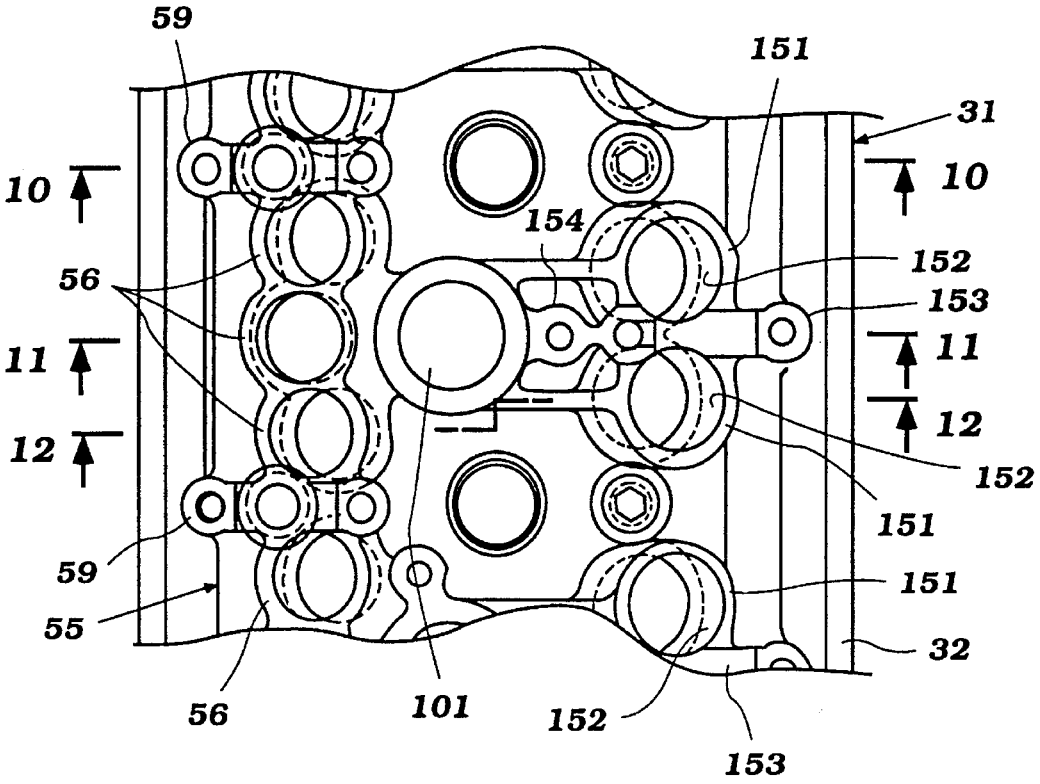
FIG. 9 is a partial top plan view with portions removed, similar to FIGS. 1 and 5, and shows yet another embodiment of the invention.
Figure 10:
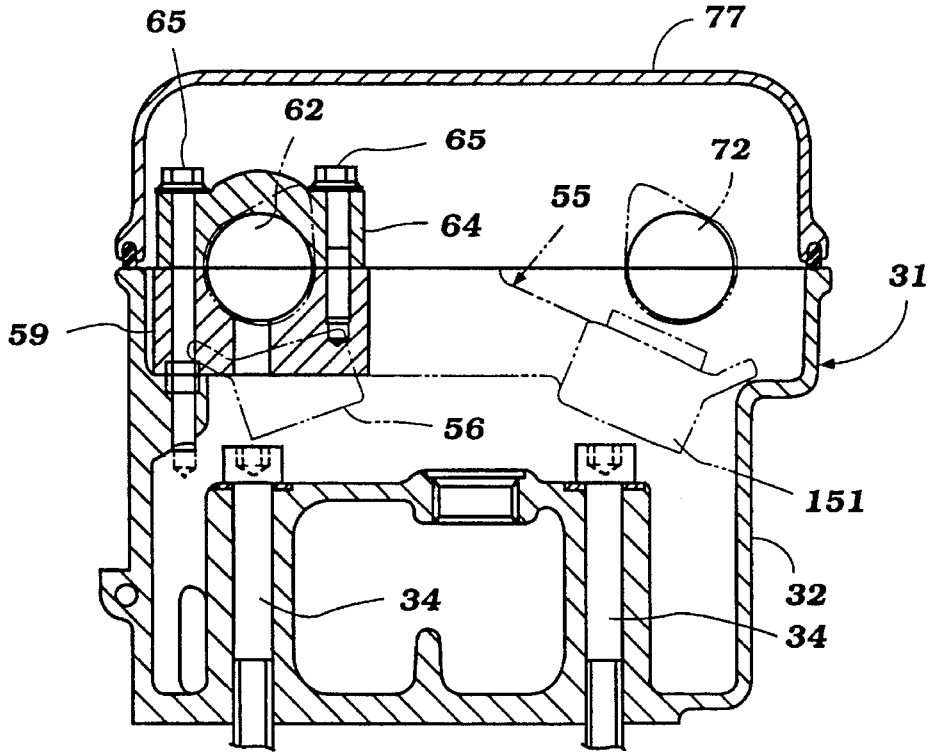
FIG. 10 is a cross sectional view taken along the line 10—10 FIG. 9 and shows the removed components.
Figure 11:
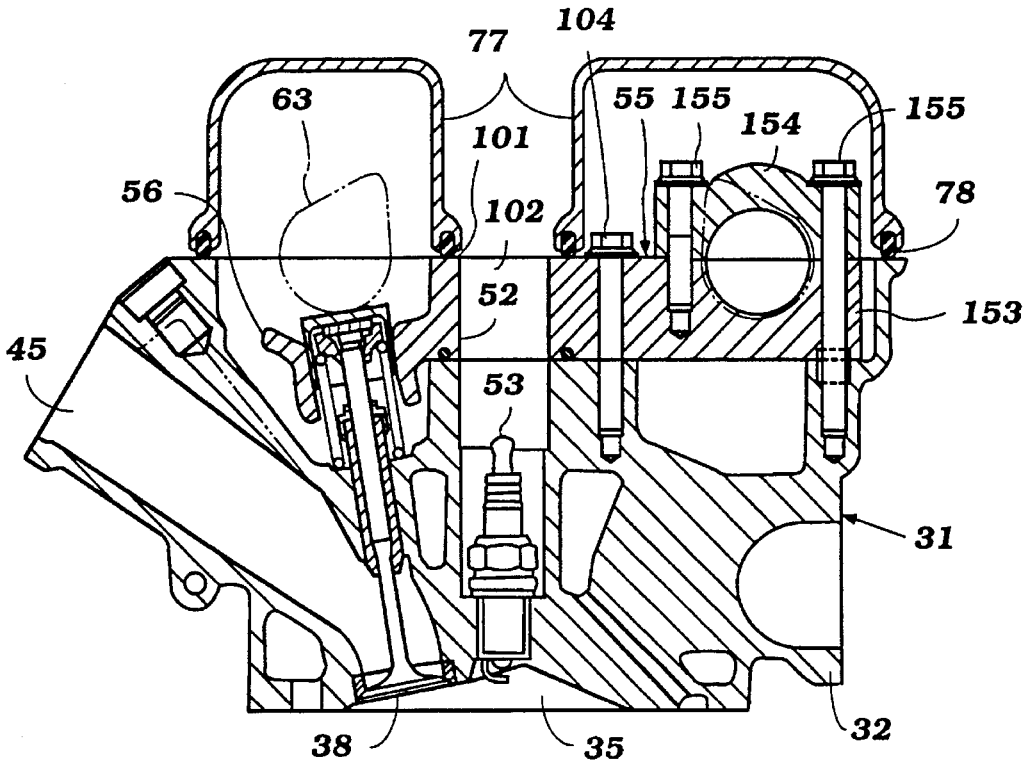
FIG. 11 is a cross sectional view taken along the line 11—11 of FIG. 9 and shows the removed components.
Figure 12:
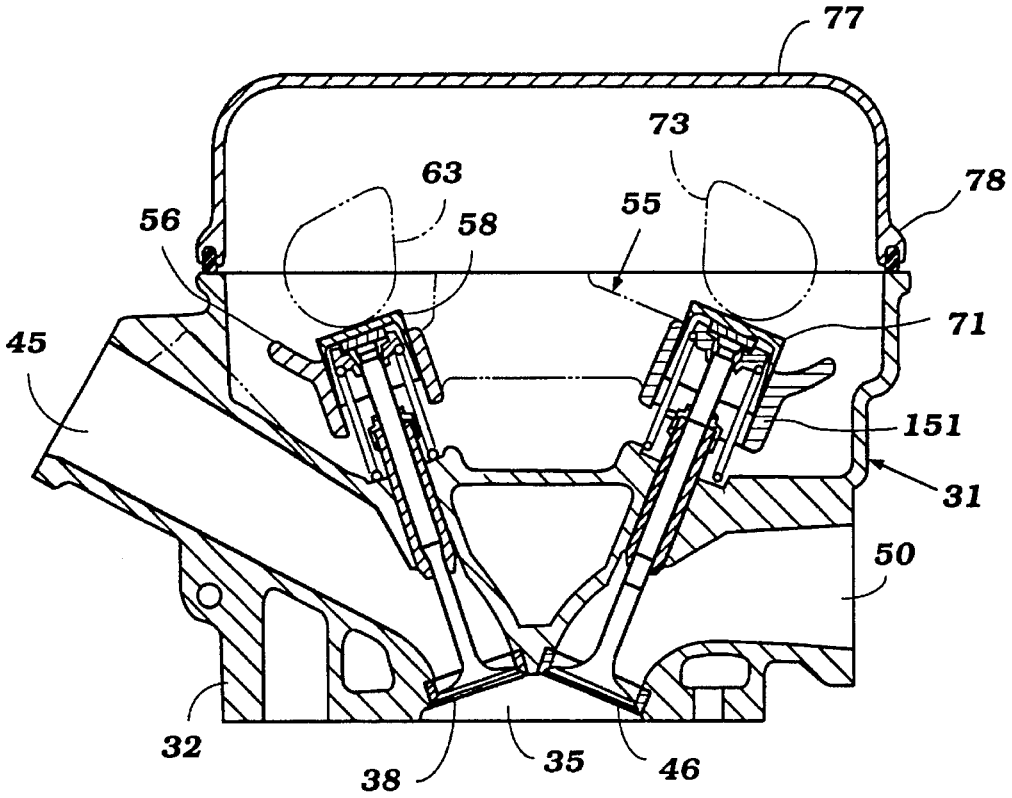
FIG. 12 is a cross sectional view taken along the line 12—12 of FIG. 9 and shows the removed components.

FIGS. 5 through 8 show another embodiment of the invention which is generally the same as the embodiment of FIGS. 1 through 4 and for that reason parts which are the same or substantially the same as the previously described embodiment are identified by the same reference numerals and will be described again only in so far as is necessary to understand the construction and operation of this embodiment. The main difference between this embodiment and that previously disclosed is that the cam and tappet carrier 55 is provided with an extension 101 that extends from the tappet bosses 56 but toward the exhaust side of the engine and which is in registry with the spark plug well 52 of the cylinder head member 32 as best shown in FIG. 7. This boss 101 has an opening 102 that is aligned with that of the cylinder head member 52 and also the corresponding opening 79 of the cam cover 77 so that the spark plugs 53 can be removed and installed without removing either the cam cover 77 or the cam and tappet carrier 55.

The spark plug boss 101 is provided with a pair of lugs that have bored openings 103 so as to pass fasteners (not shown) which fasteners also secure the cam and tappet carrier 55 to the cylinder head member 32. These threaded fasteners appear at 104 in FIG. 8 and it will be seen that certain of these fasteners extend over onto the exhaust side of the engine.

With this embodiment, a small 0-ring seal 105 (FIG. 7) may be provided in the lower face of the bosses 101 for sealing with the cylinder head member 32 and the cam cover 77 also carries gaskets 81 for sealingly engaging the upper surface of the bosses 101 rather than the cylinder head member 32 as in the previously described embodiment.

FIGS. 9 through 12 show another embodiment of the invention which is generally similar to the embodiment of FIGS. 5 through 8, and, for that reason, components of this embodiment which are the same or substantially the same as those of the preceding embodiment have been identified by the same reference numerals. The difference between the embodiment of FIG. 9 through 12 and the embodiment of FIGS. 5 through 8 is that the exhaust camshaft and exhaust actuating tappets 72 and 71, respectively, of this embodiment are also formed integrally with the cam and tappet carrier 55.

To accomplish this, the spark plug boss portions 101 are provided with further extensions 151 that are bored at 152 so as to receive and slidably support the exhaust tappets 71. In addition, an exhaust camshaft bearing lower half 153 is formed integrally between the bosses 151 for each cylinder and is connected to a boss 154 formed from the spark plug boss 101. Bearing caps 154 are affixed to the bosses 153 by threaded fasteners 155. Hence, it should be apparent that this construction permits ease of formation of both tappet and bearings for both the intake and exhaust valves while retaining all of the advantages of the other embodiments.

Figure 13:
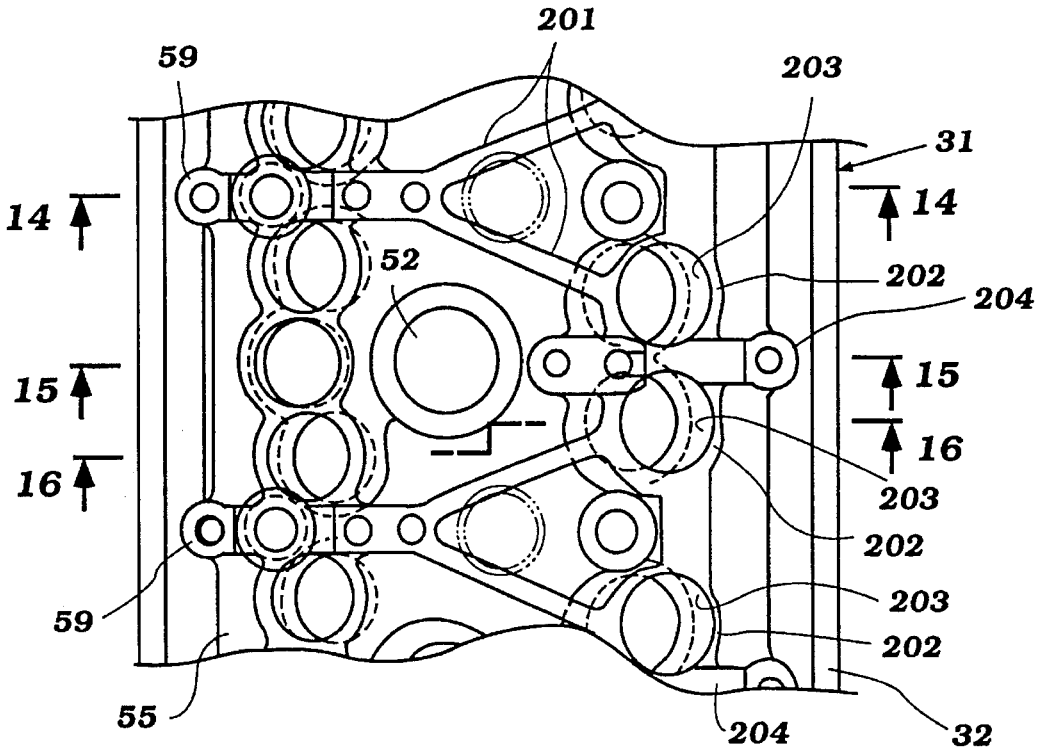
FIG. 13 is a partial top plan view, in part similar to FIGS. 1, 5 and 9, with components removed, and shows another embodiment of the invention.
Figure 14:
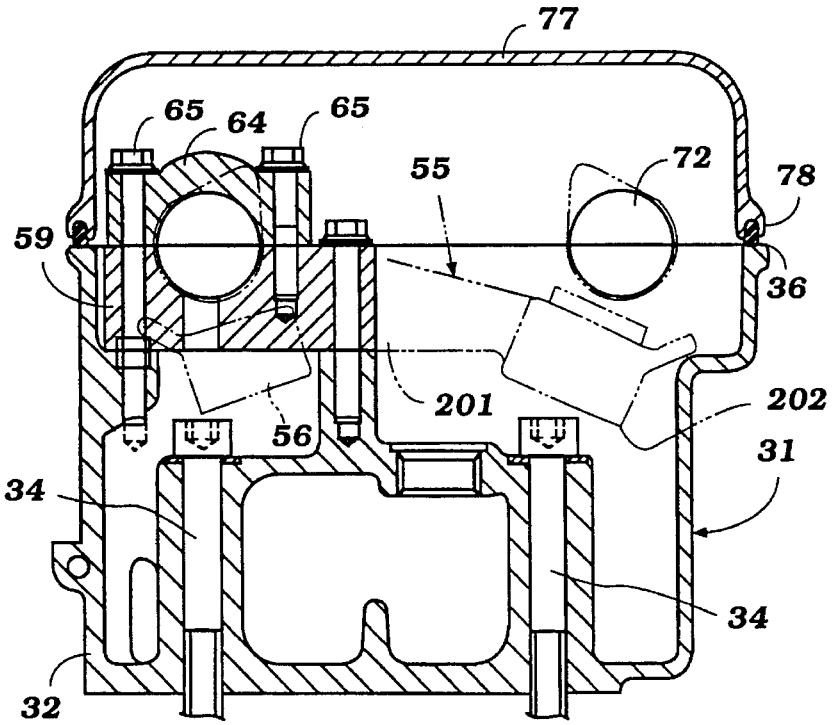
FIG. 14 is a cross sectional view taken along the line 14—14 of FIG. 13 with the removed components shown in position.
Figure 15:
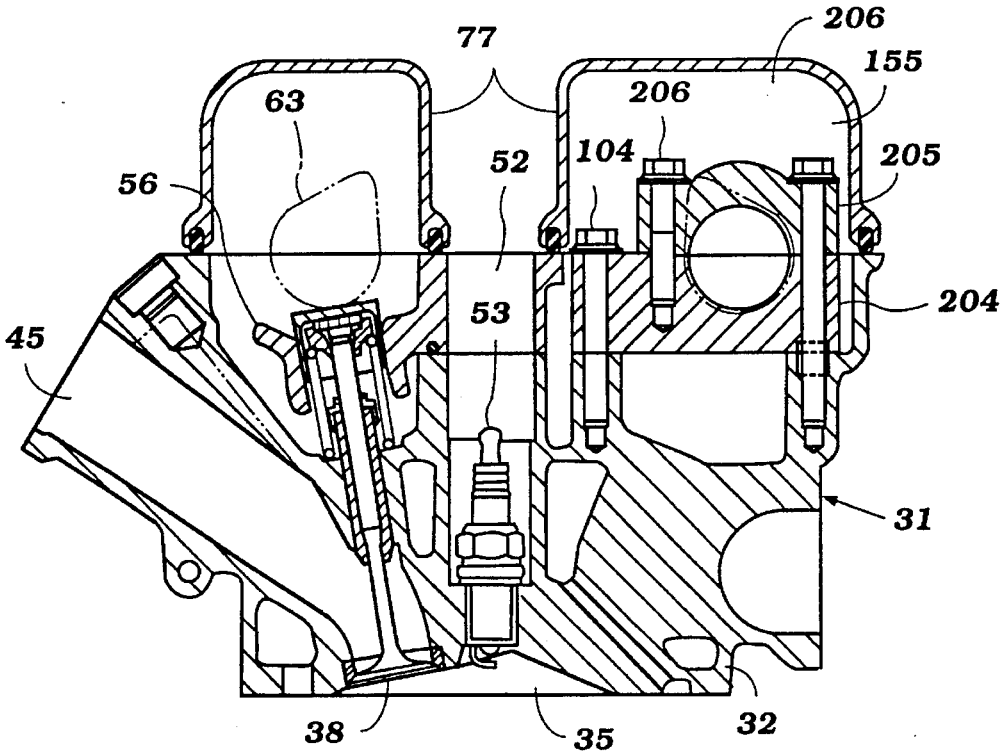
FIG. 15 is a cross sectional view taken along the line 15—15 of FIG. 13 showing the components in place.
Figure 16:
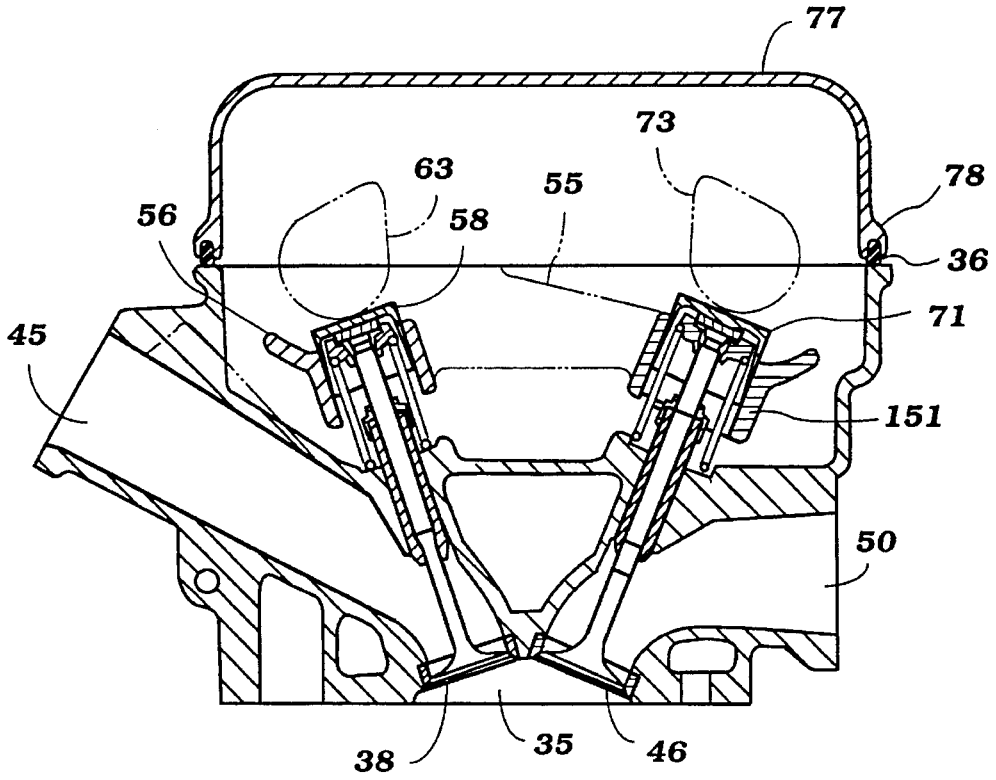
FIG. 16 is a cross sectional view taken along the line 16—16 of FIG. 13 showing the removed components in place.
Figure 17:
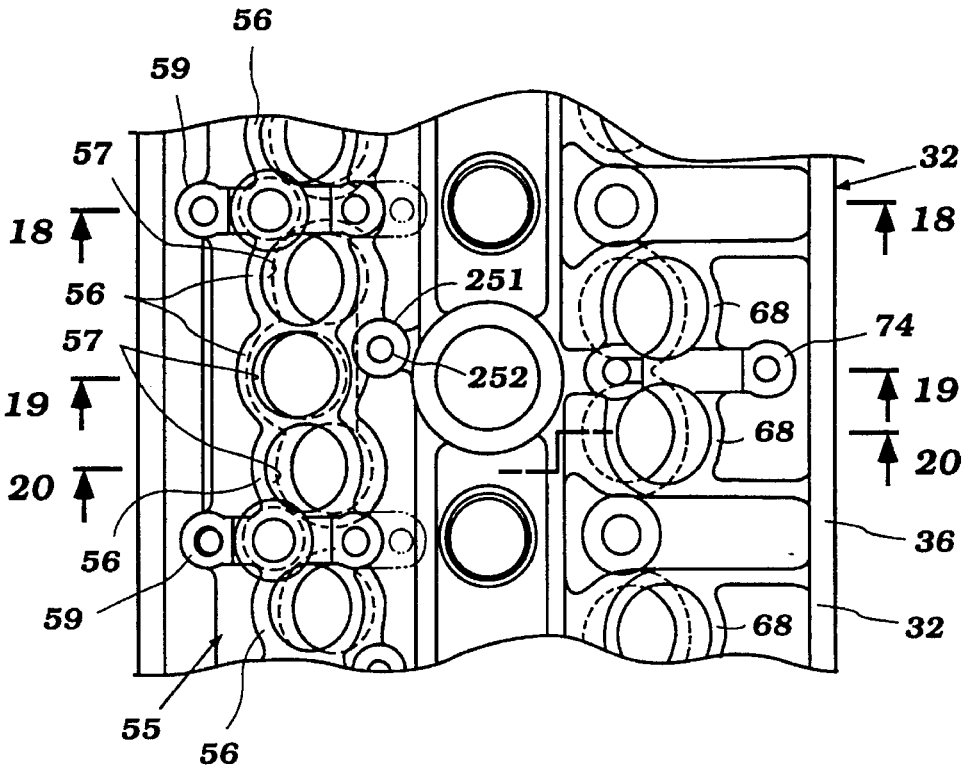
FIG. 17 is a partial top plan view with components removed, in part similar to FIGS. 1, 5, 9 and 13, and shows yet another embodiment of the invention.
Figure 18:
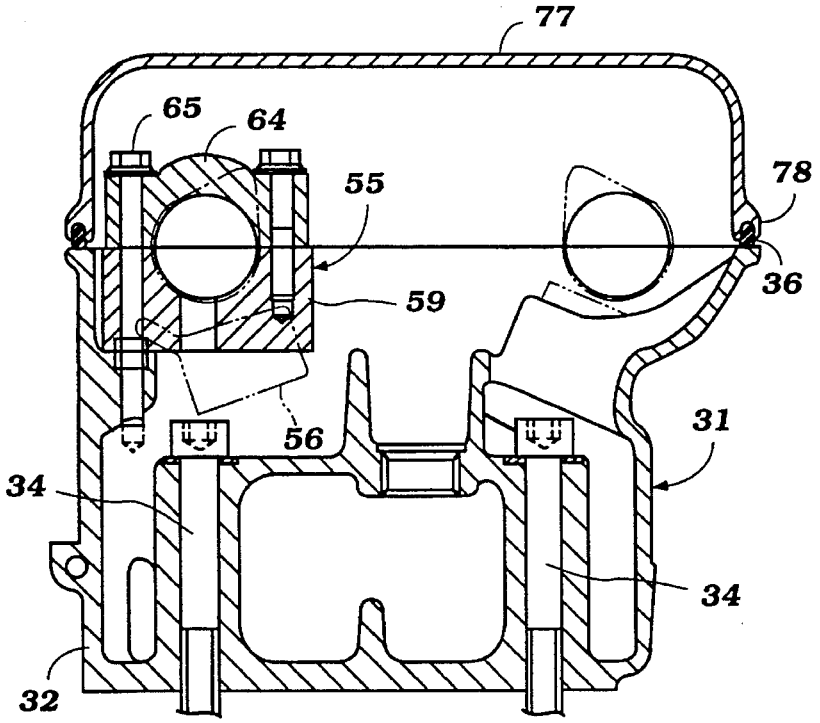
FIG. 18 is a cross sectional view taken along the line 18—18 of FIG. 17 with the removed components in place.
Figure 19:
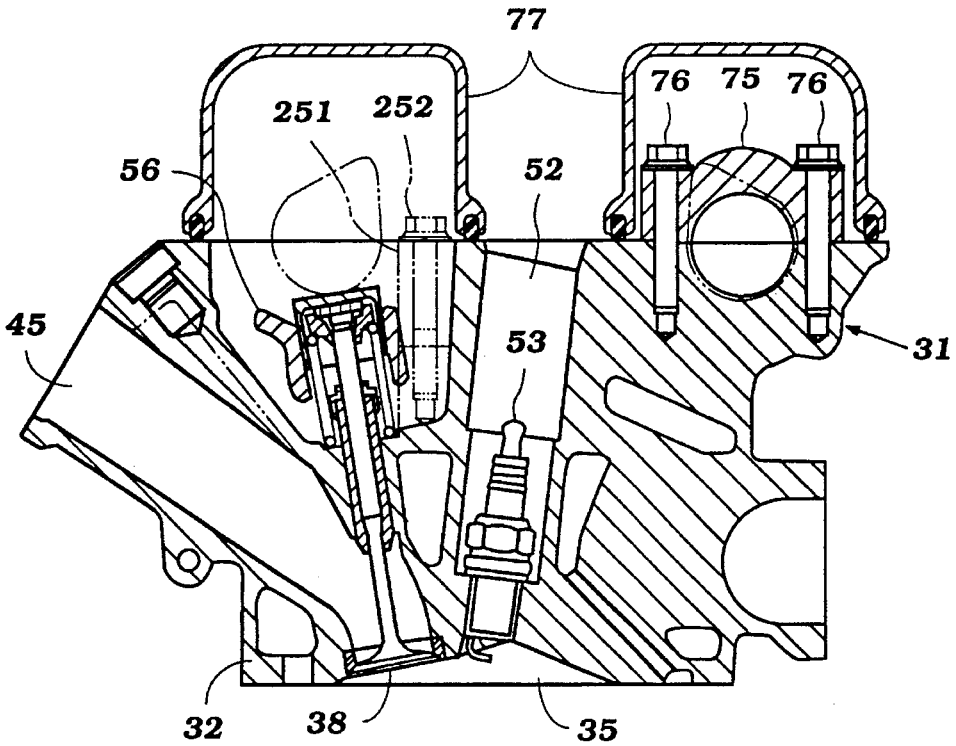
FIG. 19 is a cross sectional view taken along the line 19—19 of FIG. 17 with the removed components in place.
Figure 20:
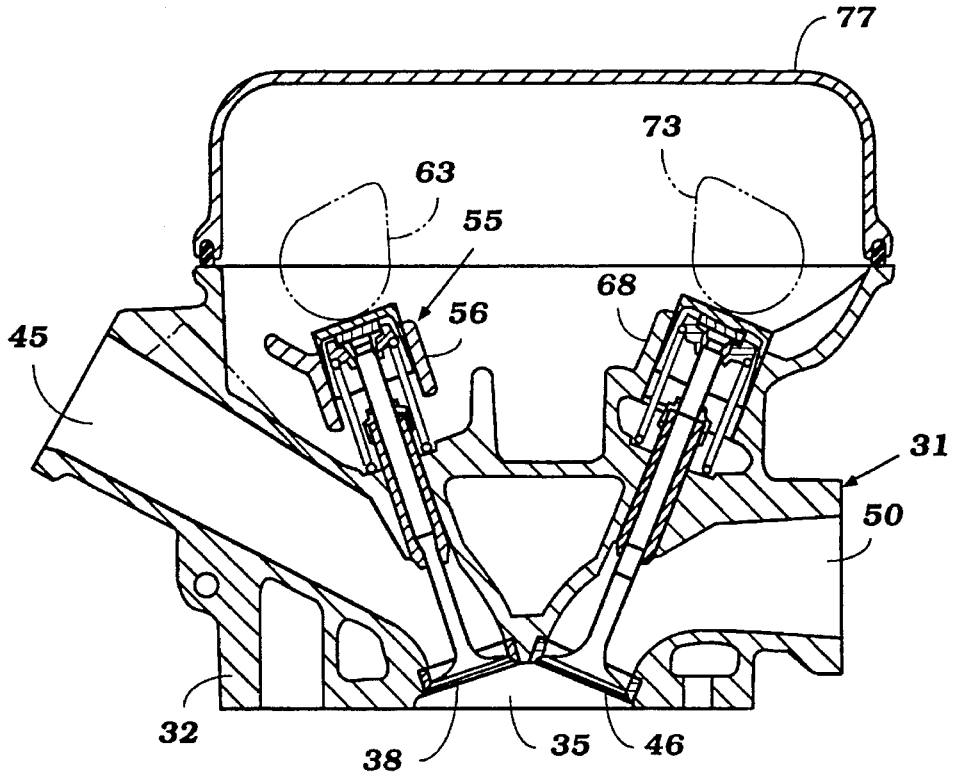
FIG. 20 is a cross section view taken along the line 20—20 of FIG. 17 with the removed components in place.

FIGS. 13 through 15 show an embodiment which is similar to the embodiment of FIGS. 9 through 12 and, for that reason, components of this embodiment which are the same as the embodiment of FIGS. 9 through 12 have been identified by the same reference numerals and will not be described again, except in so far as is necessary to understand the construction and operation of this embodiment.

This embodiment differs from that of FIGS. 9 through 12 in eliminating the spark plug boss portions 101 of the cam and tappet carrier 55 while still retaining the support for both intake and exhaust camshafts 62 and 72, and all of the intake tappets 58 and exhaust tappet 71. Thus, it is not necessary in this embodiment for the cam cover 77 or cylinder head member 32 to have any sealing relationship with the cam and tappet carrier 55, thus limiting some of the machine surfaces on it.

In this embodiment, the intake cam bearing portions 59 of the cam and tappet carrier 55 have a pair of Y-shaped extensions 201 that extend toward the exhaust side of the cylinder head assembly 31 across the,spark plug well 52 of the cylinder head member 32 and thus spa it. These extensions carry integrally tappet supporting bars 202 that are formed with tappet receiving bores 203 for slidably supporting the exhaust tappets 71. In addition, cam bearing bridges 204 are formed between the tappet bores 203 associated with each cylinder and form the lower bearing half for the exhaust camshaft 72. A bearing cap 205 is affixed to each of the beams 204 by threaded fasteners 206.

Referring now to the embodiment of FIGS. 17 through 20, this is an embodiment which is similar to the embodiment of FIG. 1 through 4, but shows a slightly different way in which the cam and tappet carrier 55 may be affixed to the main cylinder head 32. In this embodiment, there is provided an additional boss 251 on the tappet carrying portion 56 of the cam and tappet carrier 55 between two of the tappet receiving bores 57. This boss receives a threaded fastener 252 which serves to affix the cam and tappet carrier member 55 directly to the main cylinder head member 32. In all other regards, this embodiment is the same as that of FIGS. 1 through 4 and, for that reason, further description of this embodiment is believed to be unnecessary.

Figure 21:
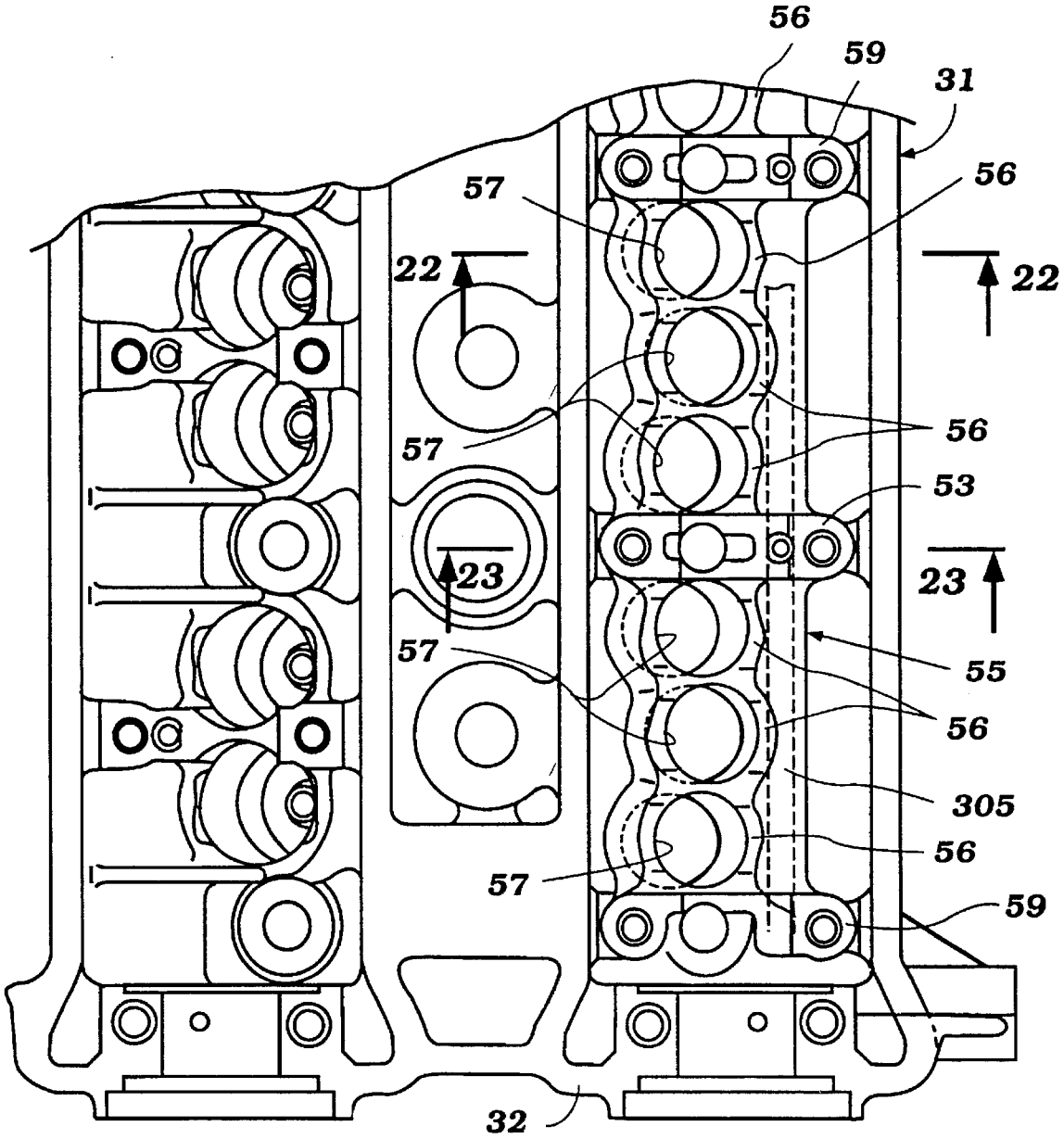
FIG. 21 is a partial top plan view with components removed, in part similar to FIGS. 1, 5, 9, 13 and 17, and shows a still further embodiment of the invention.
Figure 22:
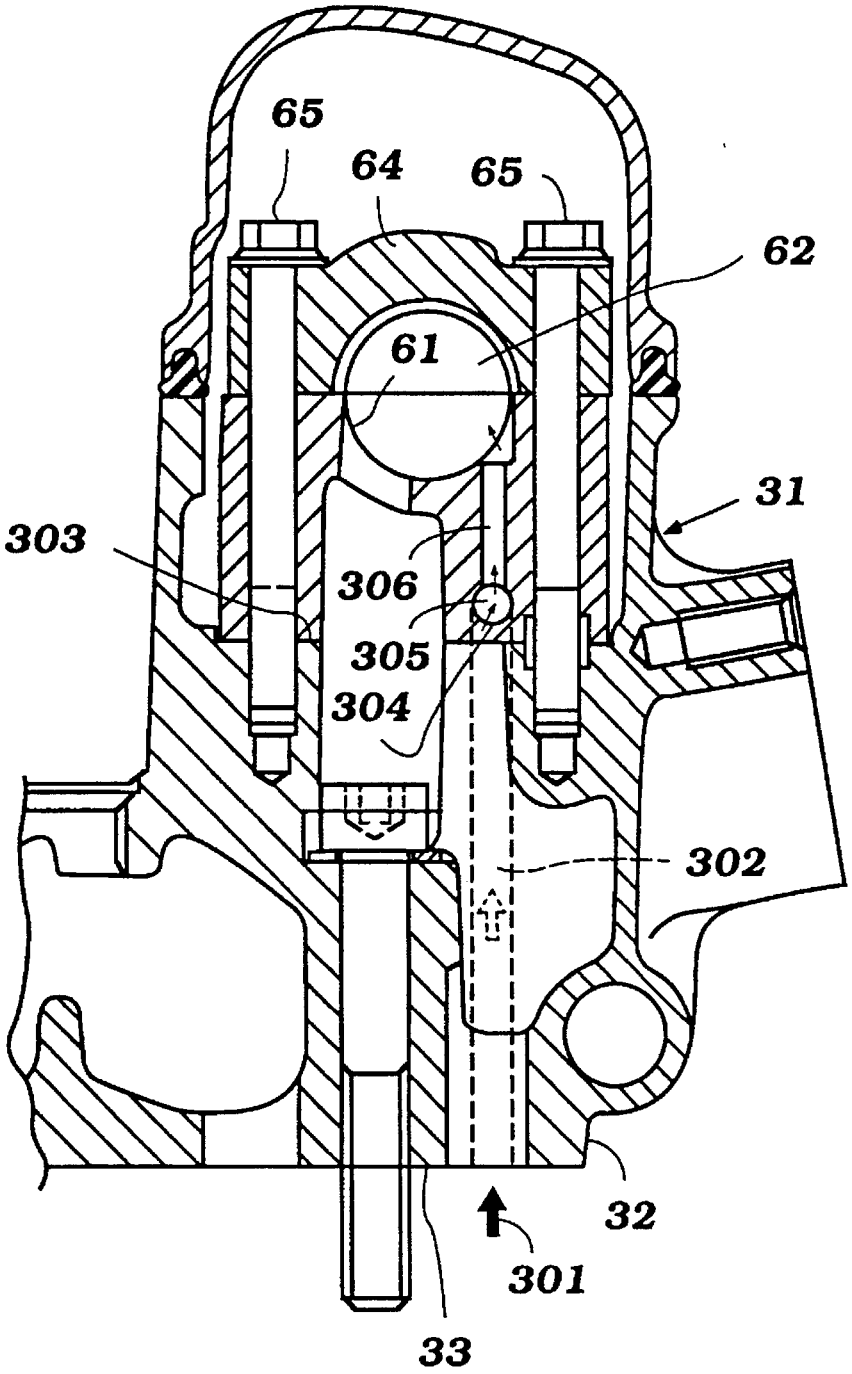
FIG. 22 is a cross section view taken along the line 22—22 of FIG. 21 with the removed components installed.
Figure 23:
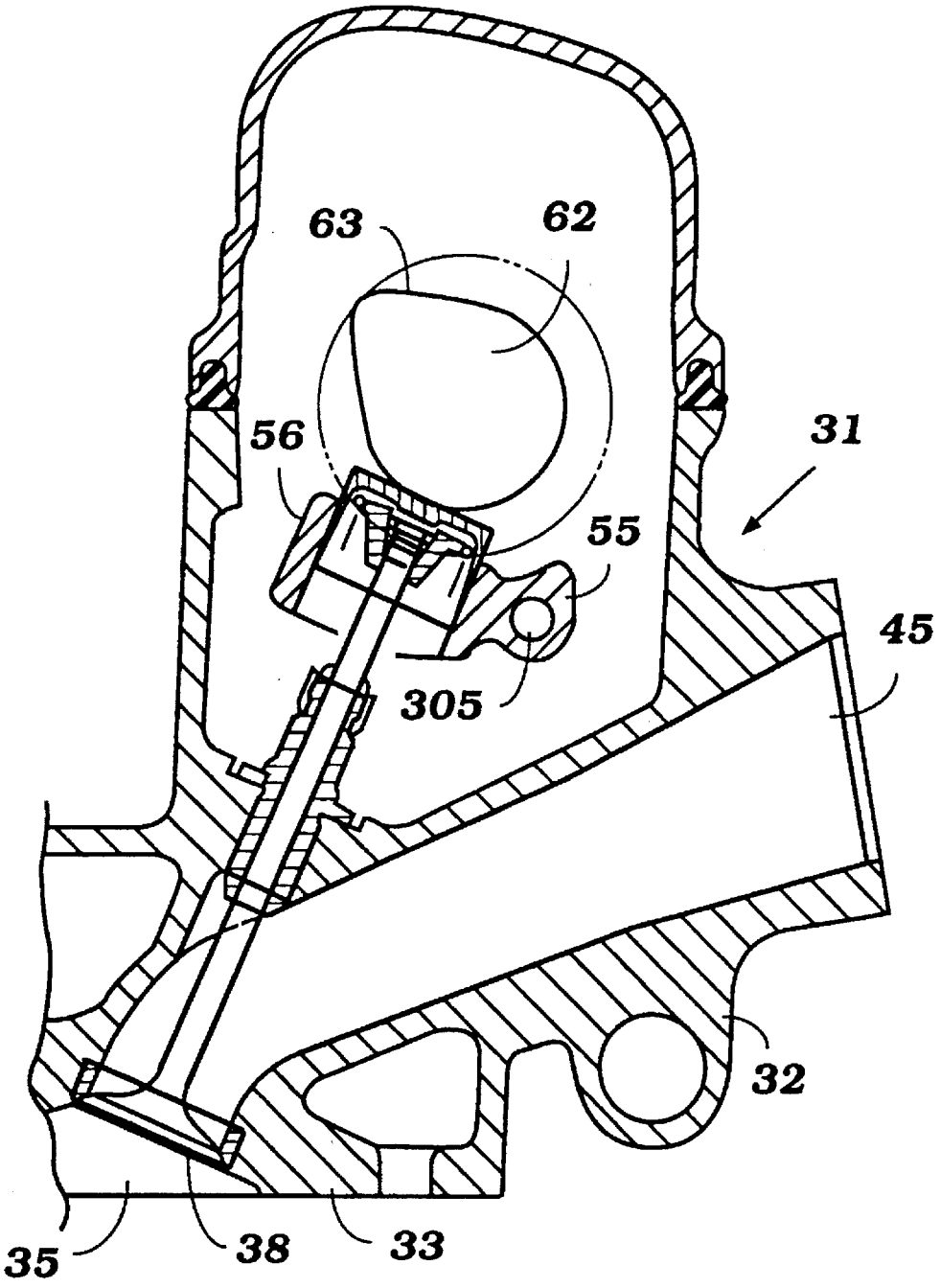
FIG. 23 is a cross section view taken along the line 23—23 of FIG. 21, again, with the removed components installed.

FIGS. 21 through 23 show how the cam and tappet carrier of any of the previously described embodiments may also function so as to deliver lubricant to the camshaft bearings and, if desired, the tappet receiving bores thus further offering simplification of the cylinder head assembly. This embodiment is the same as that of FIGS. 1 through 4, but the intake and exhaust sides are reversed in the drawings.

Because the only difference between this embodiment and that of FIGS. 1 through 14 is the way in which the lubricant is delivered, all reference numerals applied to the embodiment of FIGS. 1 through 4 will be carried over with this embodiment and only the changes will be described. It should be understood that this concept may be used with all of the embodiments in addition to that of FIGS. 1 through 4. In this embodiment, more than one cylinder is depicted so as to show how the arrangement can be utilized to deliver lubricant to all of the camshaft bearing surfaces 61, and also to the tappet bores 57, if desired.

The portion of the engine not illustrated in the drawings is provided with a lubrication system and this includes a cam lubricant delivery passage that extends up through the cylinder block to the surface of the cylinder block that is sealingly engaged with the cylinder head surface 33. This oil delivery passage is indicated by the arrow 301 in FIG. 22. This passage communicates with a drilled passage 302 that extends through the main cylinder head member 32 from its cylinder block sealing surface 33 to a surface 303 that is engaged by one of the boss portions 59 of the cam and tappet carrier 55. The lower surface of the cam and tappet carrier is formed with a corresponding drilling 304 which is intersected by a longitudinally extending main gallery 305 that is easily formed through drilling the cam and tappet carrier 55. Once drilled, the ends of the gallery 305 are closed by plugs. The main gallery 305 is intersected by a plurality of supply passages 306, which are drilled through the cam bearing surface 61 and, thus, deliver lubricant to the bearings of the camshaft 62. If desired, similar cross drillings can be provided so as to communicate with the tappet bores 57.

It should be readily apparent from the foregoing description that the described embodiments of the invention are very effective in providing a cylinder head assembly that can be easily machined and assembled and, nevertheless, will accommodate a large number of tappets and support an associated actuating camshaft or camshafts. Of course, the embodiments described are only preferred embodiments of the invention, and various changes and modifications may be made without departing from the spirit and scope of the invention, as defined by the appended claims.

We claim:

1. A cylinder head assembly for an overhead camshaft engine comprising a main cylinder head member defining a lower sealing surface for sealing engagement with a cylinder block and at least one portion of said lower surface cooperating with a cylinder bore of the cylinder block to define a combustion chamber, said cylinder head member having an upper peripheral surface surrounding a cam chamber, said cam chamber being defined in part by an upper surface area of said cylinder head, said upper surface area being entirely spaced inwardly of and below said upper peripheral surface, said upper peripheral surface being adapted to be sealingly engaged with a cam cover for enclosing said cam chamber, and a cam and tappet carrier member having a lower surface area abuttingly engaged with said main cylinder head member upper surface area within said cam chamber and spaced inwardly from and below said upper peripheral surface, and fastening means affixing said cam and tappet carrier member to said cylinder head member within said cam chamber and holding said tappet carrier member lower surface area in the abutting engagement with said cylinder head member upper surface area, said cam and tappet carrier member defining at least one bearing surface for journalling a camshaft and at least one tappet bore for slidably receiving at least one bucket tappet actuated by the camshaft for operating a value supported by said main cylinder head member.

2. A cylinder head assembly for an overhead camshaft engine as set forth in claim 1 wherein the cam and tappet carrier member provides a plurality of longitudinally spaced bearing surfaces for the camshaft and a plurality of longitudinally spaced tappet bores for receiving tappets.

3. A cylinder head assembly for an overhead camshaft engine as set forth in claim 2 wherein all of the tappet bores associated with a respective combustion chamber are disposed between a pair of bearing surfaces for the camshaft and are formed by walls extending between cross ribs, forming said bearing surfaces.

4. A cylinder head assembly for an overhead camshaft engine as set forth in claim 3 further including bearing caps affixed to the cam and tappet carrier with the fastening means being operative to at least partially affix the cam and tappet carrier member to the main cylinder head member.

5. A cylinder head assembly for an overhead camshaft engine as set forth in claim 4 wherein certain of the fastening means therefore affix only the cam and tappet carrier member to the main cylinder head member.

6. A cylinder head assembly for an overhead camshaft engine as set forth in claim 5 wherein at least some of the certain fastening means pass through bores formed in bosses on the walls forming the tappet receiving bores of the cam and tappet carrier member.

7. A cylinder head assembly for an overhead camshaft engine as set forth in claim 1 wherein the cylinder head assembly has a pair of camshafts, one comprising an intake camshaft and the other comprising an exhaust camshaft journalled on opposite sides of the cylinder head assembly, the cam and tappet carrier member supporting at least one of said camshafts.

8. A cylinder head assembly for an overhead camshaft engine as set forth in claim 7 wherein the cam and tappet carrier member supports only one of the camshafts and the tappets actuated by said one camshaft.

9. A cylinder head assembly for an overhead camshaft engine as set forth in claim 8 wherein the fastening means are positioned on both sides of the cylinder head.

10. A cylinder head assembly for an overhead camshaft engine as set forth in claim 8 wherein the cam and tappet carrier member further includes a boss defining a bore for passing a spark plug.

11. A cylinder head assembly for an overhead camshaft engine as set forth in claim 10 wherein the fastening means are positioned on both sides of the cylinder head.

12. A cylinder head assembly for an overhead camshaft engine as set forth in claim 7 wherein the cam and tappet carrier member journals both of the camshafts and slidably supports all of the tappets associated with each of the camshafts.

13. A cylinder head assembly for an overhead camshaft engine as set forth in claim 12 wherein the cam and tappet carrier member comprises a pair of sections each positioned on a respective side of the main cylinder head member and each carrying the respective camshaft and tappets actuated thereby and further including bridging members extending between and integrally connecting said sections.

14. A cylinder head assembly for an overhead camshaft engine as set forth in claim 13 wherein the bridging members have openings for passing spark plugs.

15. A cylinder head assembly for an overhead camshaft engine as set forth in claim 13 wherein at least some of the bridging members are positioned between spark plugs mounted in the cylinder head.

16. A cylinder head assembly for an overhead camshaft engine as set forth in claim 1 wherein the cam and tappet carrier member lower surface area has a machined portion for abuttingly engaging a corresponding machined portion of the cylinder head member upper surface area and which machined lower surface portion is parallel to the cylinder head member lower surface and the cam bearing members are machined along an axis that is parallel to said machined surface portions, the tappet bore being disposed at an angle to said machined surface portions.

17. A cylinder head assembly for an overhead camshaft engine as set forth in claim 16 wherein the cylinder head member has an oil passage extending between its lower surface and its machined upper surface area portion and intersecting an oil passage formed in the cam and tappet carrier member machined lower surface area portion for delivering lubricant to components carried thereby.

18. A cylinder head assembly for an overhead camshaft engine as set forth in claim 17 wherein there are a plurality of cam bearing surfaces and tappet bores all served by a common oil gallery drilled longitudinally through the cam and tappet carrier member.

19. A cylinder head assembly for an overhead camshaft engine as set forth in claim 1 wherein the cylinder head member has an oil passage extending between its lower surface and the portion of the upper surface area engaged by said cam and tapper carrier member lower surface area and intersecting an oil passage formed in the cam and tapper carrier member for delivering lubricant to components carried thereby.

20. A cylinder head assembly for an overhead camshaft engine as set forth in claim 19 wherein there are a plurality of cam bearing surfaces and tappet bores all served by a common oil gallery drilled longitudinally through the cam and tappet carrier member.

* * * * *